US011745046B2

(12) United States Patent
Marazzini

(10) Patent No.: US 11,745,046 B2
(45) Date of Patent: Sep. 5, 2023

(54) BARBELL RACK INSTALLABLE ON A WALL

(71) Applicant: LACERTOSUS SRL, Parma (IT)

(72) Inventor: Alessio Marazzini, Lodi (IT)

(73) Assignee: LACERTOSUS SRL, Parma (IT)

( * ) Notice: Subject to any disclaimer, the term of this patent is extended or adjusted under 35 U.S.C. 154(b) by 0 days.

(21) Appl. No.: 17/588,808

(22) Filed: Jan. 31, 2022

(65) Prior Publication Data

US 2022/0248843 A1 Aug. 11, 2022

(30) Foreign Application Priority Data

Feb. 5, 2021 (IT) ..... 102021000002666

(51) Int. Cl.

| | |
|---|---|
| ***A63B 21/078*** | (2006.01) |
| ***A47B 43/00*** | (2006.01) |
| ***A47B 57/34*** | (2006.01) |
| ***A47B 81/00*** | (2006.01) |

(52) U.S. Cl.

CPC ..... *A63B 21/078* (2013.01); *A47B 43/00* (2013.01); *A47B 57/34* (2013.01); *A47B 81/005* (2013.01); *A63B 2210/10* (2013.01); *A63B 2210/50* (2013.01)

(58) Field of Classification Search

CPC ..... A47B 81/005; A47B 43/00; A47B 57/34; A63B 21/078; A63B 2210/10; A63B 2210/50

See application file for complete search history.

(56) References Cited

U.S. PATENT DOCUMENTS

| | | | | |
|---|---|---|---|---|
| D358,623 | S | 5/1995 | Macasieb | |
| 6,685,601 | B1 * | 2/2004 | Knapp | A63B 21/0783 482/142 |
| 7,488,277 | B1 | 2/2009 | Knapp | |
| 9,192,799 | B2 * | 11/2015 | Alenaddaf | A63B 71/0036 |
| 9,333,387 | B2 * | 5/2016 | Hopperstad | A63B 21/00047 |
| 9,409,048 | B1 | 8/2016 | Hopperstad et al. | |
| 9,498,670 | B1 | 11/2016 | Hopperstad et al. | |
| 9,517,382 | B2 * | 12/2016 | Payne | A63B 21/068 |
| 10,195,479 | B2 * | 2/2019 | Brasch | A63B 21/078 |
| 10,226,661 | B2 * | 3/2019 | Henniger | A63B 21/4035 |
| 10,632,334 | B1 | 4/2020 | Hopperstad et al. | |
| 10,953,301 | B2 * | 3/2021 | Brasch | A63B 71/0036 |
| 2009/0143203 | A1 | 6/2009 | Knapp | |

(Continued)

FOREIGN PATENT DOCUMENTS

DE 102011084318 A1 4/2013

*Primary Examiner* — Stanton L Krycinski

(74) *Attorney, Agent, or Firm* — Pearne & Gordon LLP; Bryan M. Gallo

(57) ABSTRACT

A barbell rack (1) installable on a wall, comprising:

Figure 1A:
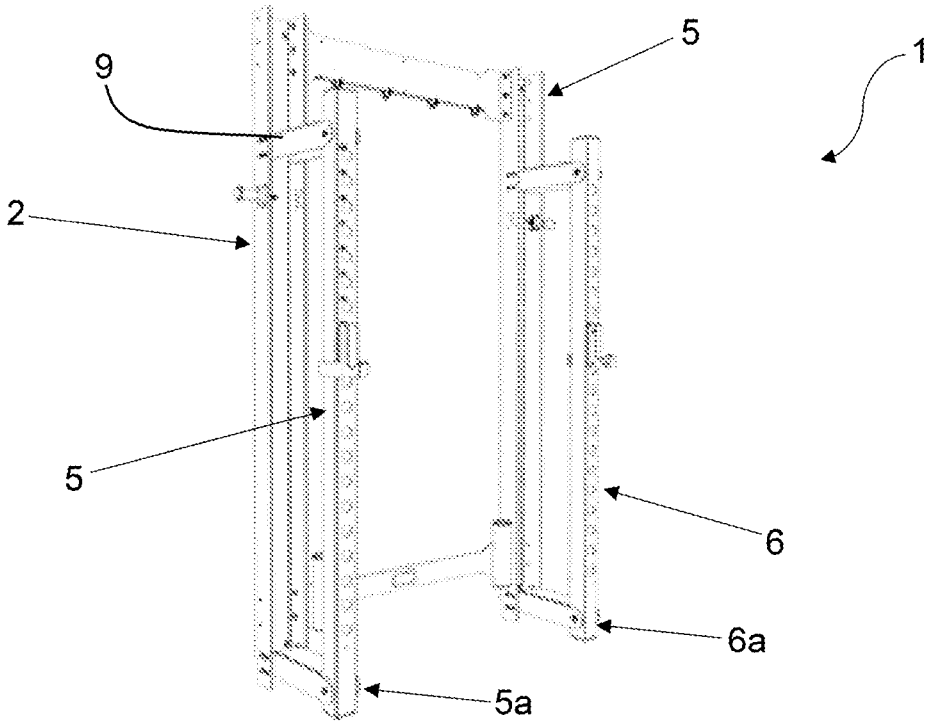

a first upright (2) and a second upright (3) fixable to the wall and distanced from one another;

a first pole (5) and a second pole (6) respectively associated to the first upright (2) and second upright (3), each of said poles (5, 6) having a plurality of holes (7) adapted to receive a support shelf (8), means for hinging (9; 10) each pole (5, 6) to the corresponding upright (2, 3) in such a way that each pole (5, 6) is movable between a use position, in which it is at a maximum distance from the corresponding upright (2, 3), and a rest position, in which it is at a minimum distance from the corresponding upright (2, 3).

9 Claims, 4 Drawing Sheets

(56) References Cited

U.S. PATENT DOCUMENTS

| | | | | |
|---|---|---|---|---|
| 2015/0290488 | A1 | 10/2015 | Hopperstad et al. | |
| 2017/0065844 | A1 | 3/2017 | Hopperstad et al. | |
| 2017/0246490 | A1 | 8/2017 | Hopperstad et al. | |
| 2018/0104522 | A1 | 4/2018 | Hopperstad et al. | |
| 2018/0290003 | A1 | 10/2018 | Hopperstad et al. | |
| 2019/0126088 | A1* | 5/2019 | Henniger ..... | A63B 23/1218 |
| 2020/0197737 | A1 | 6/2020 | Kistner et al. | |
| 2022/0016466 | A1* | 1/2022 | Henniger ..... | A63B 71/0036 |

* cited by examiner

BARBELL RACK INSTALLABLE ON A WALL

The present invention proposes a barbell rack installable on a wall. In particular, the present invention relates to the field of physical training equipment.

Barbell supports are known to be used for various types of exercises such as squats, bench presses, bar pulls, etc. A conventional barbell support comprises a base, four vertical supports extending from the base upwards and a connection structure on top of the supports. The vertical supports include openings usually equally spaced along the height to receive a barbell support bracket at the desired height. A few bars may also be placed on top of the device to allow a user to perform pull-ups.

The main problem with conventional barbell supports is that they require a significant amount of space, i.e. they are bulky, and therefore cannot be stored compactly without being disassembled.

Recently, new solutions to be fixed to a wall have been developed that have the peculiarity of being able to be made compact in situations of non-use, in order to minimize the overall dimensions. In particular, the two vertical poles that act as supports for the barbell can be rotated around a vertical hinge axis between the canonical position of use and a rest position in which they are on or near the wall. In this rest position, the poles are close together and further more internal with respect to their hinge axis.

However, in the absence of a precise installation to ensure that there are no out-of-square corners, or because of the presence of out-of-square corners between the floor and the wall, two major problems can arise. Firstly, the poles slide on the floor, making it difficult to open or damaging the floor. Secondly, the poles may be lifted off the floor in the open position, making the structure unstable. In addition, when a load is applied, a tensile pulling force is exerted on the wall supports.

In this context, the technical task underlying the present invention is to propose a barbell rack installable on a wall, that overcomes the above-mentioned drawbacks of the prior art.

In particular, the object of the present invention is to propose a barbell rack installable on a wall robust, reliable and space-saving, while at the same time easy to install.

The defined technical task and the specified aims are substantially achieved by a barbell rack installable on a wall, comprising:

- a first upright and a second upright fixable to the wall and distanced from one another;
- a first pole and a second pole respectively associated to the first upright and second upright, each of said poles having a plurality of holes adapted to receive a support shelf,
- means for hinging each pole to the corresponding upright in such a way that each pole is movable between a use position, in which it is at a maximum distance from the corresponding upright, and a rest position, in which it is at a minimum distance from the corresponding upright.

According to one embodiment, the first and the second pole are mutually parallel According to one embodiment, the barbell rack further comprises one or more support shelves installable in the holes of the first and second pole.

According to one embodiment, the first and the second pole remain parallel in the passage from the rest position to the use position, or vice versa.

According to one embodiment, the first and the second pole maintain the same distance between them in the passage from the rest position to the use position, or vice versa.

According to one embodiment, the first and the second pole are mounted on corresponding uprights in such a way that in the use position, the first and the second pole contact, at an end thereof, a floor or a ground surface.

According to one embodiment, the means for hinging comprise, for each pole, at least a first arm having a first end hinged to the corresponding upright and a second end hinged to the pole in such a way as to enable the passage of the pole from the use position to the rest position, and vice versa.

According to one embodiment, the means for hinging comprise a second arm having a first end hinged to the corresponding upright and a second end hinged to the pole.

Preferably, the rotation of the first end of the first arm with respect to the corresponding upright takes place about a horizontal axis.

According to one embodiment, each upright has a section that is substantially C- or U-shaped, each pole, in the rest position, being housed inside the corresponding upright.

Figure 1B:
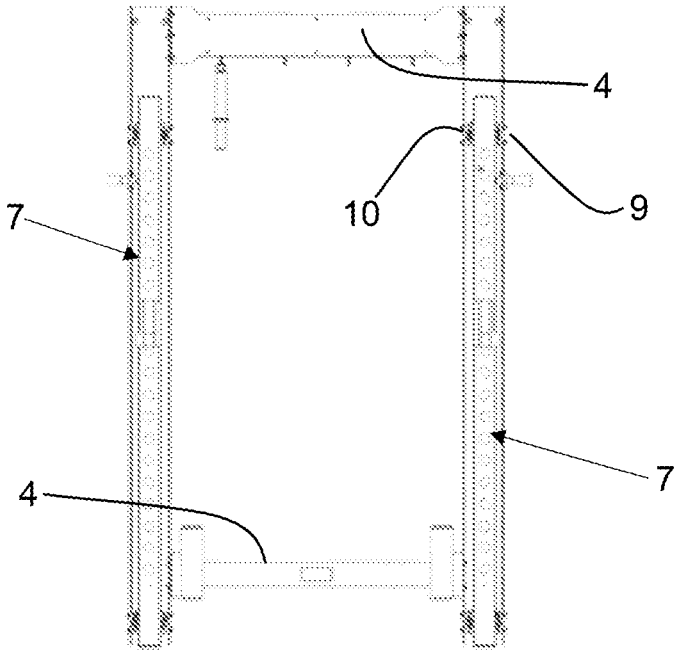
Figure 1C:
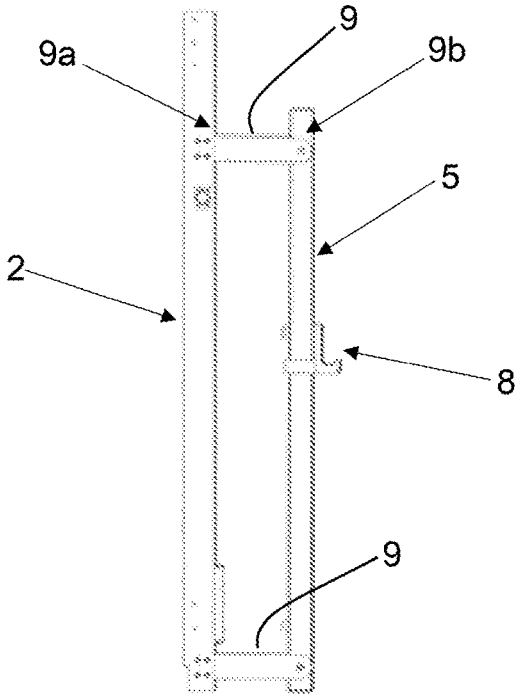
Figure 2A:
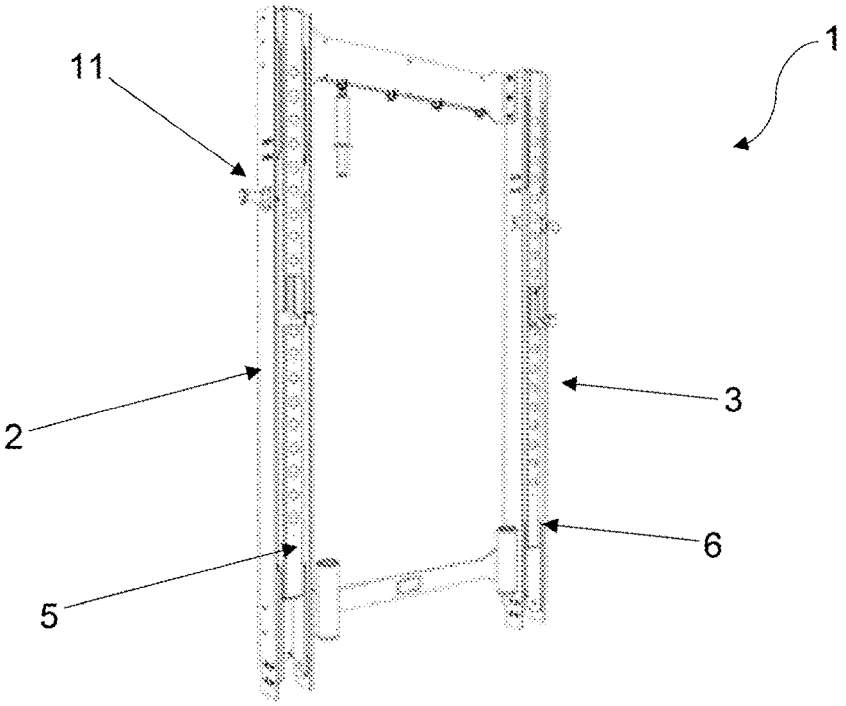
Figure 2B:
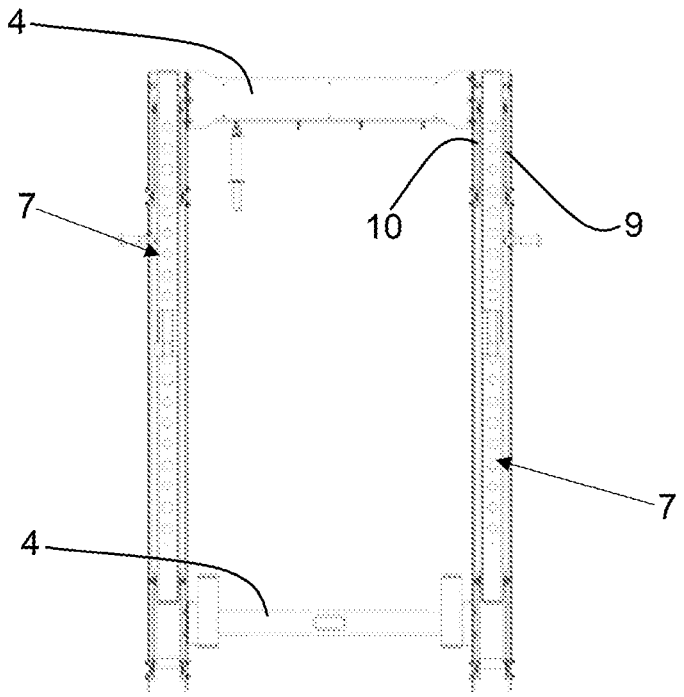
Figure 2C:
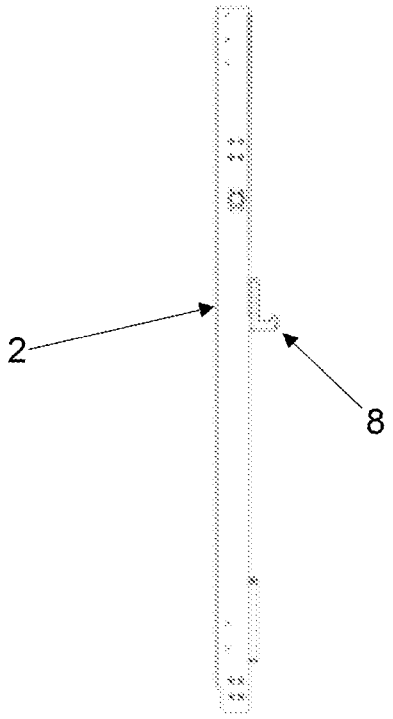
Figure 3:
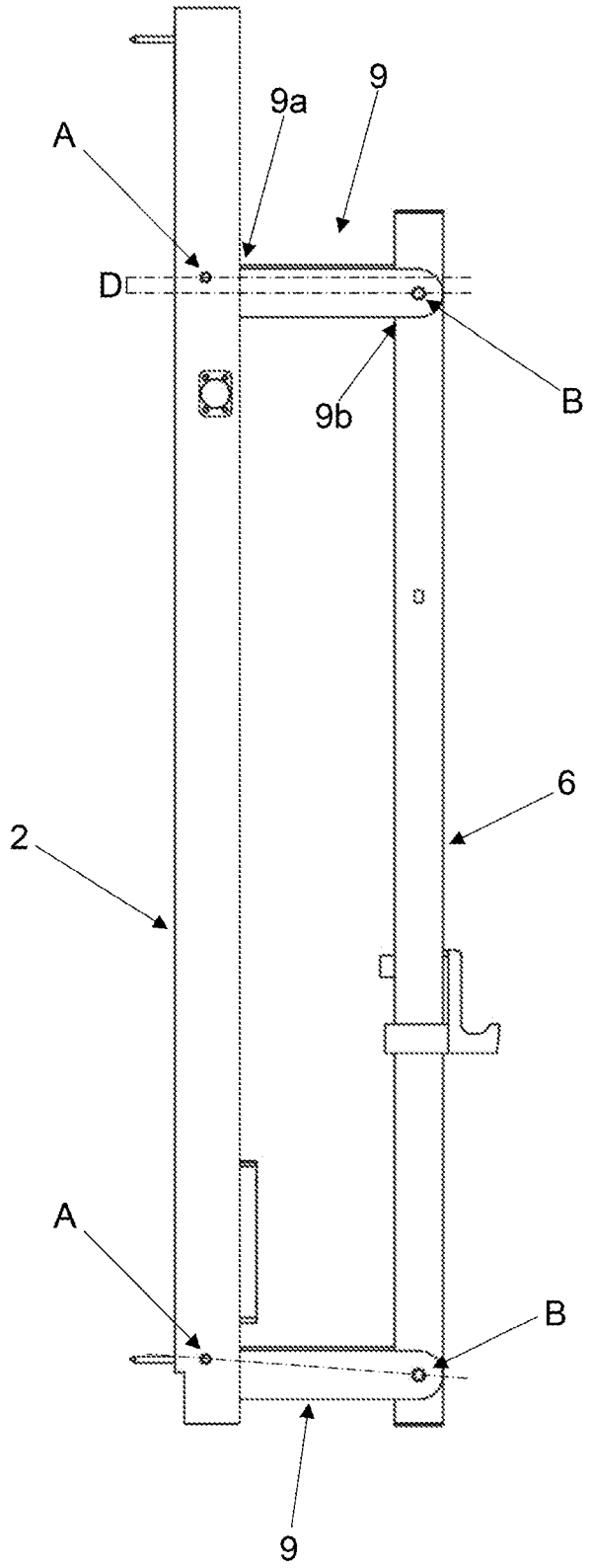

Further characteristics and advantages of the present invention will become more apparen from the indicative and thus non-limiting description of a preferred, but not exclusive, embodiment of a barbell rack installable on a wall, as illustrated in the accompanying drawings, of which:

FIGS. 1*a*, 1*b* and 1*c* respectively illustrate a perspective view, a front view and a side view of a barbell rack installable on a wall, according to the present invention, in an open configuration where the poles are in a use position;

FIGS. 2*a*, 2*b* e 2*c* respectively illustrate a perspective view, a front view and a side view of a barbell rack installable on a wall, according to the present invention, in a closed configuration where the poles are in a rest position;

FIG. 3 illustrates a lateral view of an alternative embodiment of a barbell rack installable on a wall, according to the present invention, in an open configuration where the poles are in a use position.

With reference to the figures, number 1 indicates a barbell rack installable on a wall. The present invention can be mounted in various buildings such as, for example, the interior or exterior of a building, a garage, a gym, a bedroom or the like.

The barbell rack 1 comprises a first upright 2 to be fixed to a wall. The first upright 2 has an elongated development along a first direction. Preferably, the first upright 2 has a substantially linear development. Preferably, with the barbell rack 1 fixed to the wall, the first upright 2 has a prevailing development along a first direction which is substantially vertical.

The barbell rack 1 comprises a second upright 3 to be fixed to the wall. The second upright 3 has an elongated development along a second direction. Preferably, the second upright 3 has a substantially linear development. Preferably, with the barbell rack 1 fixed to the wall, the second upright 3 has a prevailing development along a second direction which is substantially vertical.

Preferably, the first and second directions are substantially parallel.

The first and second uprights 2, 3 are spaced out from each other.

Preferably, the barbell rack 1 comprises one or more crossbars 4 between the first and second uprights 2, 3 so as to allow a better distribution of loads over the whole structure.

The barbell rack 1 comprises a first pole 5 and second pole 6 respectively associated to the first upright 2 and second upright 3. The first and second poles 5,6 are space out from each other so as to leave space for a user's body during the exercises. By way of example, the first and second poles 5, 6 are preferably spaced 25 centimetres apart.

Preferably, the first and second poles 5, 6 have the same length. By way of example, the length of the poles 5, 6 is preferably of 190 centimetres.

Preferably, the first and second poles 5, 6 are parallel to each other.

Preferably, with the barbell rack 1 fixed to the wall, both the uprights 2, 3 and the poles 5, 6 have a substantially vertical development. Consequently, their prevailing dimension, i.e. length, can also be indicated as height (e.g. in relation to the floor or ground).

Each pole 5, 6 has a plurality of holes 7 obtained along its length. A support shelf 8 of the barbell is to be coupled with one of the holes 7. In such a way, it is possible to choose the height at which to place the barbell.

Preferably, the holes 7 are equally spaced. Alternatively, some of the holes 7 are spaced with a smaller pitch, for example halved, to allow a more accurate adjustment of the support brackets 8.

The barbell rack 1 comprises means for hinging 9 each pole 5, 6 to the corresponding upright 2, 3 in such a way that each pole 5, 6 is movable between a use position, in which it is in front of and at a maximum distance from the corresponding upright 2, 3, and a rest position, in which it is side by side in contact with or at a minimum distance from the corresponding upright 2, 3.

In particular, when the pole 5, 6 is in the use position, it is at a maximum distance from the corresponding upright 2, 3 so that this pole 5, 6 protrudes more from the wall than when it is in the rest position.

For example, the maximum distance is between 25 and 90 centimetres.

Preferably, the first and the second pole 5, 6 are moved so as to remain parallel in the passage from the rest position to the use position, or vice versa.

Preferably, the first and the second pole 5, 6 maintain the same distance between them in the passage from the rest position to the use position, or vice versa.

Preferably, the poles 5, 6 are higher in the rest position than when they are in the use position, as shown by comparing FIGS. 1*a*-2*a* and 1*b*-2*b*.

Preferably, the first and second poles 5, 6 are mounted on corresponding uprights 2, 3 in such a way that, in the use position, the first and the second pole 5, 6 contact, at an end thereof, a floor or a ground surface.

According to one embodiment, the movement of the first pole 5 from the rest position to the use position (and vice versa) is independent of the similar movement of the second pole 6.

In other words, the first pole 5 and the second pole 6 are movable independently from the rest position and the use position (and vice versa). In the embodiment here described and illustrated, the first and second poles 5, 6 have a substantially rectangular cross-section. According to one embodiment, the cross-section is substantially square.

Preferably, the first and second poles 5, 6 are tubular elements. This allows the best possible support for a loaded barbell, while ensuring a relatively light structure for the movement between the two positions.

Alternatively, the first and second poles 5, 6 have a solid cross-section. In the embodiment here described and illustrated, the means for hinging comprise for each pole 5, 6 at least a first arm 9. The first arm 9 of each pole 5, 6 has a first end 9*a* hinged to the corresponding upright 2, 3 and a second end 9*b* hinged to the pole 5, 6 in such a way as to enable the passage of the pole 5, 6 from the use position to the rest position, and vice versa.

According to one embodiment, illustrated in FIG. 3, the first end 9*a* of the first arm 9 is hinged to the corresponding upright 2, 3 at a first height. The second end 9*b* is hinged to the pole 5, 6 at a second height. The first height and the second height are different from each other. Height here means the distance from a floor or a ground surface.

In other words, there is a vertical gap D between the hinge axes of the first arm 9 respectively to the upright 2, 3 and the pole 5, 6.

With reference to FIG. 3, the hinge point of the first end 9*a* to the corresponding upright 2, 3 has been indicated as A, whereas the hinge point of the second end 9*b* to the pole 5, 6 has been indicate as B. The corresponding hinge axes have development entering the sheet and normal to it and passing through points A or B.

As visible in FIG. 3, the straight line passing through A and B is not horizontal, but inclined with respect to the horizontal, that is to say the hinge points A, B are not horizontally aligned.

Preferably, the means for hinging further comprise a second arm 10. The second arm 10 of each pole 5, 6 has a first end (not shown in figures) hinged to the corresponding upright 2, 3 and a second end (not shown in figures) hinged to the pole 5, 6.

For each pole 5, 6, the first and second arms 9, 10 are parallel to each other and share the hinge axes to the pole 5, 6 and to the corresponding upright 2, 3. the first and second arms 9, 10 of each pole 5, 6 so define a pair of arms 9, 10.

Preferably, the hinge axes are substantially horizontal with respect to the floor or the ground.

According to one alternative embodiment, the first arm 9 (and the second arm 10 as well, when present) comprises two consecutive portions further hinged together. In particular, the first portion is hinged on one side to the pole 2, 3 and on the other side to the second portion; the second portion is hinged on one side to the first portion and on the other side to the upright 5, 6. This allows the pole to be advanced away from the wall by twice the amount possible in the configuration described above, especially without varying its height above the ground by a distance equal to the length of the pivoted arm.

In the embodiment here described and illustrated, the barbell rack 1 comprises a plurality of pair of arms 9, 10 for each pole 5, 6. Preferably, two pairs of arms 9, 10 are provided for each pole 5, 6 so as to form a parallelogram structure.

In the embodiment here described and illustrated, each upright 2, 3 has a section that is substantially C- or U-shaped. In such a way, each pole 5, 6 in the rest position is housed inside the corresponding upright 2, 3, thus reducing the overall dimensions. Preferably, in the rest position each pole 5, 6 is in contact with the corresponding upright 2, 3 in which it is housed. In the use position, instead, each pole 5, 6 is removed from the corresponding upright 2, 3 and brought to the maximum distance from the latter.

In other words, the barbell rack 1 is foldable.

Preferably, the barbell rack 1 comprises a locking system for selectively locking the poles 5, 6 in the rest position. The user can lock the poles 5, 6 in the rest position to prevent them from accidentally falling downwards in the use position, with the risk of damaging equipment or injuring people.

In the embodiment here described and illustrated, the first upright 2 has a first hole on the outer side. Similarly, a second hole is made in the first pole 5 so that, in the rest position, it faces the first hole (made in the upright 2). A locking pin 11 is selectively insertable in the first and second holes to lock the first pole 5.

A locking system as described above can also be applied in the same terms to the second pole 6 and the second upright 3, as shown in the attached figures.

According to one embodiment, a magnetic coupling is provided between each pole 5, 6 and the corresponding upright 2, 3 in such a way that the poles 5, 6 are kept in the rest position.

From the description given, the characteristics of the barbell rack installable on a wall, according to the present invention, will be clear, as will the resulting advantage thereof.

In particular, the housing of the poles within the support elements, the described means for hinging, the movement of the poles and their construction all contribute to a robust, reliable, space-saving and easy-to-install barbell rack.

The invention claimed is:

1. A barbell rack installable on a wall, comprising:

a first upright and a second upright fixable to the wall and distanced from one another;

a first pole and a second pole respectively associated to the first upright and second upright, each of said poles having a plurality of holes adapted to receive a support shelf, means for hinging each pole to the corresponding upright in such a way that each pole is movable between a use position, in which it is at a maximum distance from the corresponding upright, and a rest position, in which it is at a minimum distance from the corresponding upright, wherein each upright has a substantially C- or U-shaped section within the upright, each pole in the rest position being completely housed inside the corresponding upright.

2. The barbell rack according to claim 1, wherein the first and the second pole are mutually parallel.

3. The barbell rack according to claim 1, further comprising one or more support shelves installable in the holes of the first and second pole.

4. The barbell rack according to claim 3, wherein the first and the second pole remain parallel in the passage from the rest position to the use position, or vice versa.

5. The barbell rack according to claim 1, wherein the first and the second pole maintain the same distance between them in the passage from the rest position to the use position, or vice versa.

6. The barbell rack according to claim 1, wherein the first and the second pole are mounted on corresponding uprights in such a way that in the use position, the first and the second pole contact, at an end thereof, a floor or a ground surface.

7. The barbell rack according to claim 1, wherein the means for hinging comprise, for each pole, at least a first arm having a first end hinged to the corresponding upright and a second end hinged to the pole in such a way as to enable the passage of the pole from the use position to the rest position, and vice versa.

8. The barbell rack according to claim 7, wherein the means for hinging comprise a second arm having a first end hinged to the corresponding upright and a second end hinged to the pole.

9. The barbell rack according to claim 7, wherein the rotation of the first end of the first arm with respect to the corresponding upright takes place about a horizontal axis.

* * * * *